US008684768B2

(12) United States Patent
Huang et al.

(10) Patent No.: US 8,684,768 B2
(45) Date of Patent: Apr. 1, 2014

(54) DIGITAL VISUAL INTERFACE DUAL-STACK CONNECTOR

(75) Inventors: Chung-Pin Huang, Miao-li County (TW); Wen-Sheng Liu, Pingtung County (TW)

(73) Assignee: Wieson Technologies Co., Ltd., New Taipei (TW)

( * ) Notice: Subject to any disclaimer, the term of this patent is extended or adjusted under 35 U.S.C. 154(b) by 30 days.

(21) Appl. No.: 13/604,008

(22) Filed: Sep. 5, 2012

(65) Prior Publication Data

US 2014/0065878 A1 Mar. 6, 2014

(51) Int. Cl.
*H01R 13/60* (2006.01)

(52) U.S. Cl.
USPC ..... 439/541.5; 439/79

(58) Field of Classification Search
USPC ..... 439/79, 80, 541.5, 607.01
See application file for complete search history.

(56) References Cited

U.S. PATENT DOCUMENTS

| | | | | |
|---|---|---|---|---|
| 7,677,923 | B1 * | 3/2010 | Chen et al. | 439/541.5 |
| 7,699,627 | B2 * | 4/2010 | Xiang et al. | 439/79 |
| 7,922,524 | B2 * | 4/2011 | Huang et al. | 439/541.5 |
| 2011/0039450 | A1 * | 2/2011 | Huang et al. | 439/607.01 |

* cited by examiner

*Primary Examiner* — James Harvey
(74) *Attorney, Agent, or Firm* — Muncy, Geissler, Olds & Lowe, P.C.

(57) ABSTRACT

A digital visual interface dual-stack connector includes a holder base and a first connector and a second connector mounted in the holder base at different elevations, the second connector having multiple second terminal pins arranged in three sets and mounted in a slotted mating body portion of a housing thereof, each second terminal pin defining a vertical rear bonding portion, a horizontal front contact portion, an oblique support arm portion and two curved portions respectively connected between the vertical rear bonding portion and horizontal front contact portion and the two ends of the support arm portion. By means of controlling the bending angles of the two curved portions of the second terminal pins and the pitch between each two adjacent second terminal pins, the invention accurately achieves impedance matching to reduce high frequency signal reflection, enhancing signal transmission stability and reliability.

10 Claims, 8 Drawing Sheets

DIGITAL VISUAL INTERFACE DUAL-STACK CONNECTOR

BACKGROUND OF THE INVENTION

1. Field of the Invention

The present invention relates to digital visual interface connector technology and more particularly, to a digital visual interface dual-stack connector, which accurately achieves impedance matching to reduce high frequency signal reflection by means of controlling the bending angles of curved portions of the second terminal pins of the second connector thereof and the pitch between each two adjacent second terminal pins, enhancing signal transmission stability and reliability.

2. Description of the Related Art

Today's transmission technology has entered the digital era. Users and manufacturers have become increasingly demanding in the quality of digital display. The ongoing progress of display card hardware-combined digital display interface standards attracts much people's attention. High speed transmission technology keeps improving to satisfy digital audio and video transmission requirements. Digital Visual Interface (DVI) is a video display interface developed by the Digital Display Working Group (DDWG). The digital interface is used to connect a video source to a display device, such as a computer monitor. DVI was developed to create an industry standard for the transfer of digital video content.

The interface is designed to transmit uncompressed digital video and can be configured to support multiple modes such as DVI-D (digital only), DVI-A (analog only), or DVI-I (digital and analog). Featuring support for analog connections as well, the DVI specification provides optional compatibility with the VGA interface. This compatibility along with other advantages led to widespread acceptance in the PC industry over other competing digital standards. Though predominantly found in computer devices, DVI is also present in some consumer electronics such as LCD, digital projector, DVD player, set-top box, D-VHS player, video receiver and other consumer electronic products sets. DVI connectors are intensively used in different electronic products for connection to a notebook computer or the panel of a LCD TV or display means. The DVI connector usually contains pins to pass the DVI-native digital video signals. In the case of dual link systems, additional pins provide increased bandwidth allowing higher resolutions and longer distances. The DVI connector includes three types: DVI-D (digital only, single-link or dual-link), DVI-A (analog only), DVI-I (integrated, combines digital and analog in the same connector; digital may be single- or dual-link). Further, commercial DVI connectors are generally of a single layer design, not able to satisfy high bandwidth and multi-display transmission requirements. In order to eliminate the problem of port occupation by multiple display cards and to facilitate wiring arrangement, DVI dual-stack connectors are created. A DVI dual-stack connector provides multiple signal transmission channels to satisfy high bandwidth and multi-display transmission requirements. However, the designs of commercial DVI dual-stack connectors do not consider the factors of high frequency signal transmission characteristics (such as electromagnetic interference, impedance matching), i.e., prior art DVI dual-stack connectors cannot achieve perfect impedance matching to reduce high frequency signal reflection, leading to poor signal transmission stability and reliability.

SUMMARY OF THE INVENTION

The present invention has been accomplished under the circumstances in view. It is therefore the main object of the present invention to provide a digital visual interface dual-stack connector, which accurately achieves impedance matching to reduce high frequency signal reflection, enhancing signal transmission stability and reliability.

To achieve this and other objects of the present invention, a digital visual interface dual-stack connector comprises a holder base, and a first connector and a second connector mounted in the holder base at different elevations. The second connector comprises a housing defining a slotted mating body portion, and a plurality of second terminal pins. The second terminal pins are arranged in three sets, i.e., the inner set, the outer set and the middle set between the inner set and the outer set. These three sets of second terminal pins are respectively mounted in the slotted mating body portion of the housing at different elevations. Further, each second terminal pin comprises a vertical rear bonding portion, a horizontal front contact portion, an oblique support arm portion and two curved portions respectively connected between the vertical rear bonding portion and horizontal front contact portion and the two ends of the support arm portion. By means of changing the bending angles of the two curved portions of the second terminal pins, the width and/or length of the second terminal pins, and/or the pitch between each two adjacent second terminal pins, the invention accurately achieves impedance matching to reduce high frequency signal reflection, enhancing signal transmission stability and reliability.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
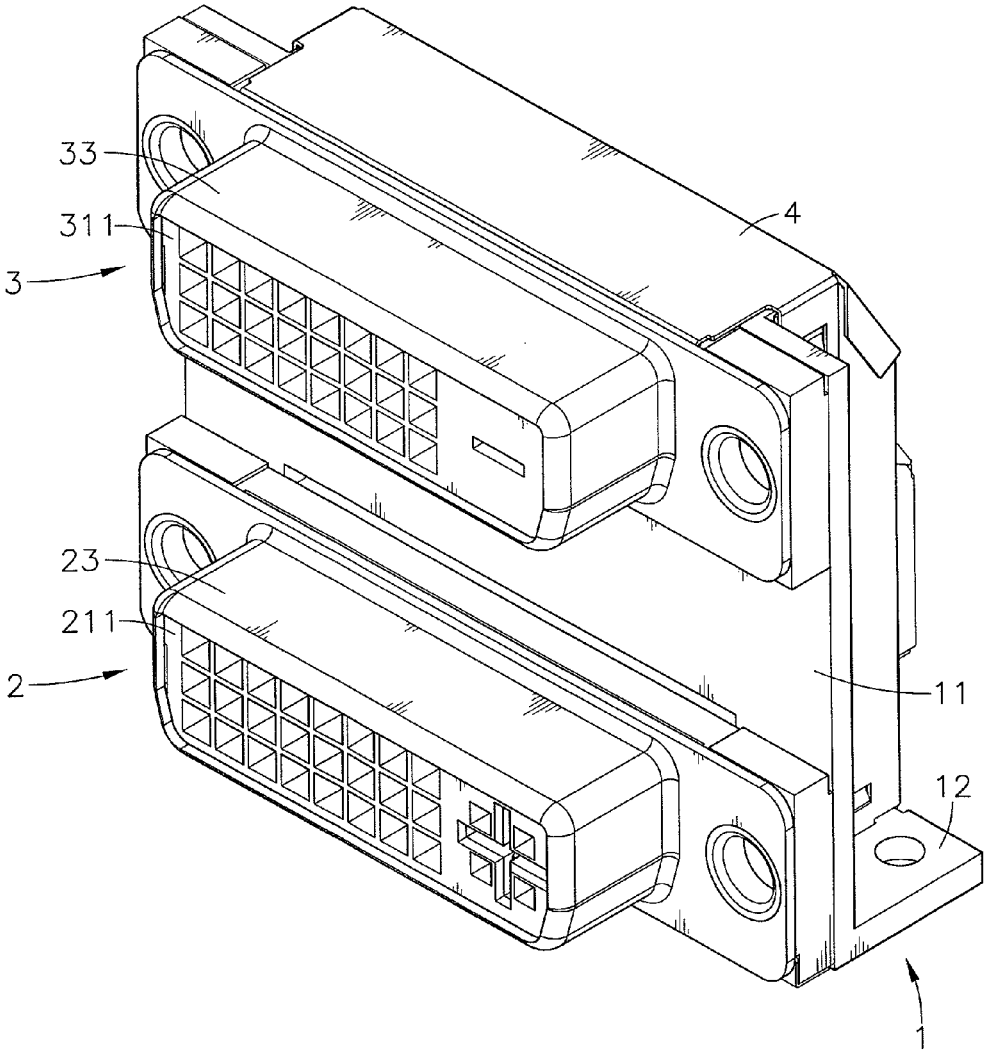
FIG. 1 is an elevational view of a digital visual interface dual-stack connector in accordance with the present invention.
Figure 2:
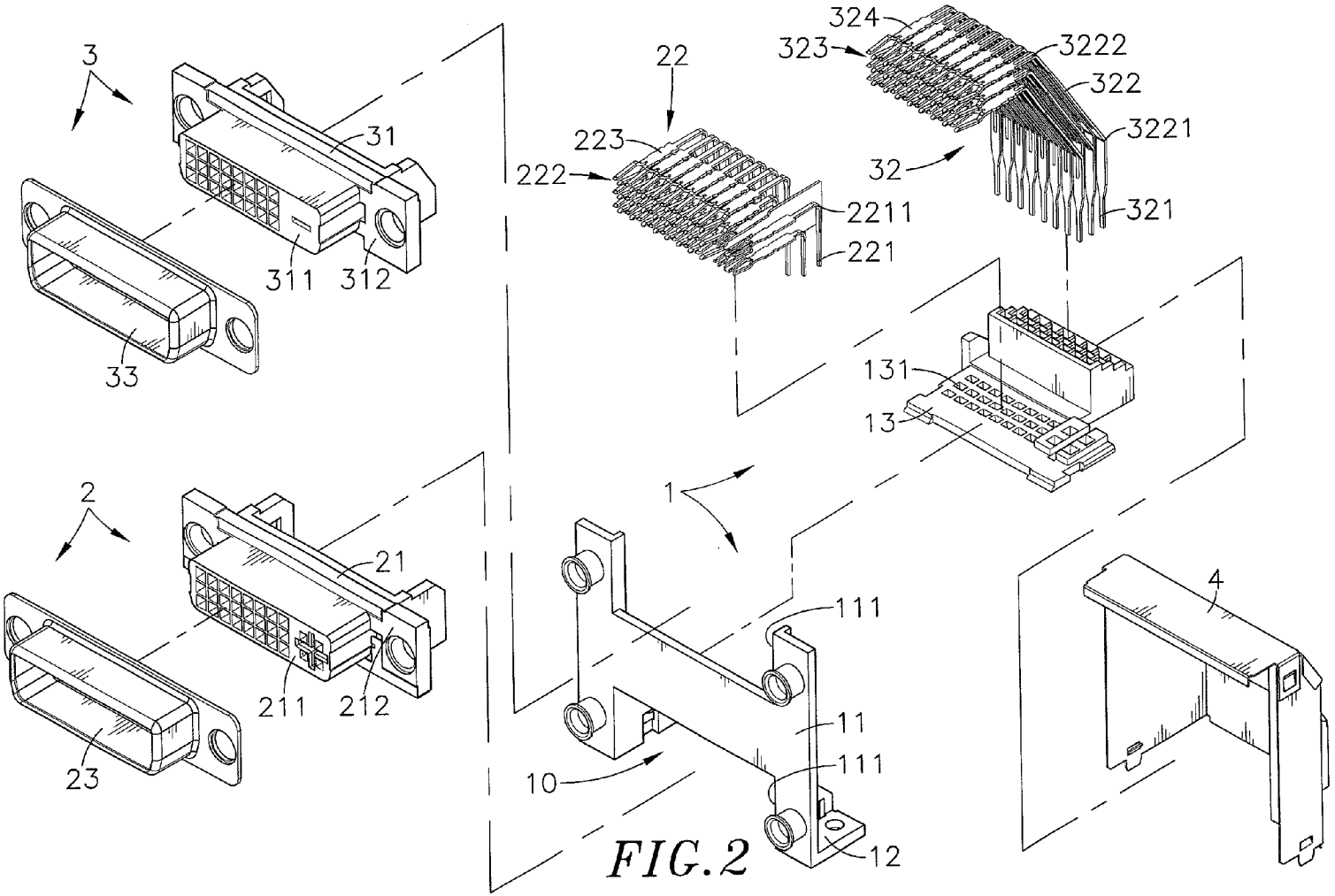
FIG. 2 is an exploded view of the digital visual interface dual-stack connector in accordance with the present invention.
Figure 3:
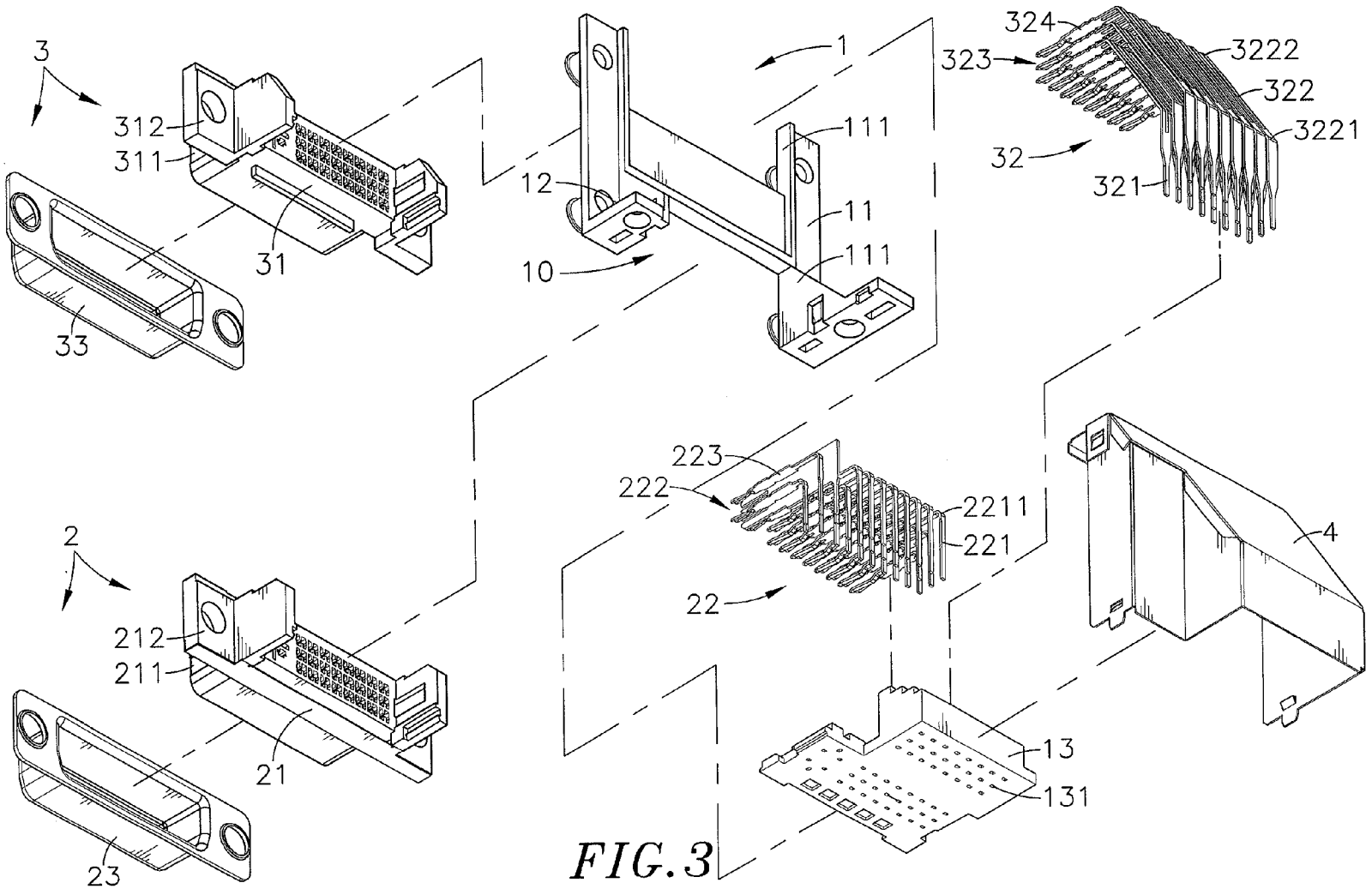
FIG. 3 corresponds to FIG. 2 when viewed from another angle.
Figure 4:
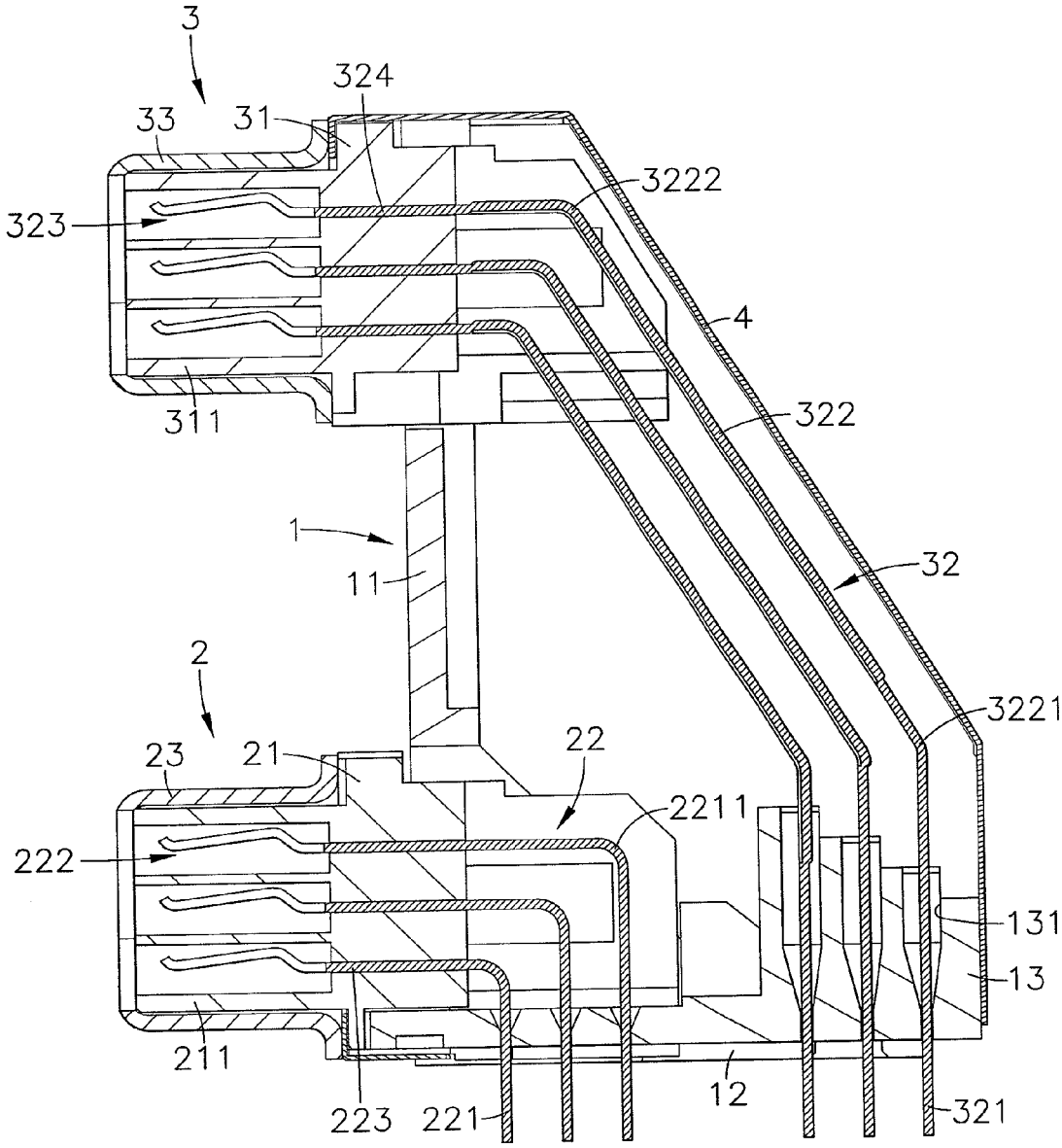
FIG. 4 is a sectional side view of the digital visual interface dual-stack connector in accordance with the present invention.

Referring to FIGS. 1-4, a digital visual interface dual-stack connector in accordance with the present invention is shown.

The digital visual interface dual-stack connector comprises a holder base 1, a first connector 2, and a second connector 3.

The holder base 1 comprises a vertical frame member 11, two horizontal frame members 12 formed integral with and bilaterally perpendicularly extended from the bottom side of the vertical frame member 11, two connector accommodation spaces 111 defined in top and bottom sides of the vertical frame member for accommodating the first connector 2 and the second connector 3 respectively, a terminal block accommodation space 10 defined between the two horizontal frame members 12 in communication with the bottom-sided connector accommodation space 111, a terminal block 13 accommodated in the terminal block accommodation space 10, and a plurality of through holes 131 cut through opposing top and bottom sides of the terminal block 13.

The first connector 2 comprises a housing 21, a plurality of first terminal pins 22, and a slotted cover shell 23. The housing 21 comprises a slotted mating body portion 211 configured to hold the first terminal pins 22 therein, and two mounting flanges 212 respectively extended from two opposite lateral sides thereof for fastening to the vertical frame member 11 of the holder base 1. The slotted cover shell 23 is configured to be capped onto a slotted mating body portion 211 of the housing 21. The first terminal pins 22 are arranged in three sets, each first terminal pin 22 defining a vertical rear bonding portion 221 vertically inserted through one respective through hole 131 of the terminal block 13, a horizontal front contact portion 222 suspending in the slotted mating body portion 211 of the housing 21, a positioning portion 223 connected between the horizontal front contact portion 222 and the vertical rear bonding portion 221 and positioned in the slotted mating body portion 211 of the housing 21, and a bent 2211 connected between the vertical rear bonding portion 221 and the positioning portion 223.

The second connector 3 comprises a housing 31, a plurality of second terminal pins 32, and a slotted cover shell 33. The housing 31 comprises a slotted mating body portion 311 configured to hold the second terminal pins 32 therein, and two mounting flanges 312 respectively extended from two opposite lateral sides thereof for fastening to the vertical frame member 11 of the holder base 1. The slotted cover shell 33 is configured to be capped onto the slotted mating body portion 311 of the housing 31. The second terminal pins 32 are arranged in three sets, each second terminal pin 32 defining a vertical rear bonding portion 321 vertically inserted through one respective through hole 131 of the terminal block 13, a horizontal front contact portion 323 suspending in the slotted mating body portion 311 of the housing 31, a positioning portion 324 connected between the horizontal front contact portion 323 and the vertical rear bonding portion 321 and positioned in the slotted mating body portion 311 of the housing 31, a support arm portion 322 obliquely connected between the vertical rear bonding portion 321 and the positioning portion 324, a first curved portion 3221 connected between the vertical rear bonding portion 221 and the support arm portion 322, and a second curved portion 3222 connected between the support arm portion 322 and the positioning portion 324.

When assembling the digital visual interface dual-stack connector, attach the housing 21 of the first connector 2 to the connector accommodation space 111 in the bottom side of the vertical frame member 11 of the holder base 1 to let the slotted mating body portion 211 of the housing 21 of the first connector 2 protrude over the front side of the vertical frame member 11 of the holder base 1, and then affix the two mounting flanges 212 of the housing 21 of the first connector 2 to the vertical frame member 11 of the holder base 1 by screws, rivets or any suitable fastening means, and then attach the housing 31 of the second connector 3 to the connector accommodation space 111 in the top side of the vertical frame member 11 of the holder base 1 to let the slotted mating body portion 311 of the housing 31 of the second connector 3 protrude over the front side of the vertical frame member 11 of the holder base 1, and then affix the two mounting flanges 312 of the housing 31 of the second connector 3 to the vertical frame member 11 of the holder base 1 by screws, rivets or any suitable fastening means, and thus, the holder base 1, the first connector 2 and the second connector 3 are assembled into a double-layer connector structure.

After fixation of the first connector 2 and the second connector 3 to the vertical frame member 11 of the holder base 1, insert the terminal block 13 upwardly into the terminal block accommodation space 10 in the vertical frame member 11 of the holder base 1 between the two horizontal frame members 12, enabling the vertical rear bonding portions 221 of the first terminal pins 22 and the vertical rear bonding portions 321 of the second terminal pins 32 to pass through the respective through holes 131 of the terminal block 13 and to suspend below the elevation of the horizontal frame members 12 of the holder base 1 for electrically bonding to an external circuit board. Thereafter, affix a metal shield 4 to the holder base 1 over the back side of the first connector 2 and the back side of the second connector 3 for connection to the external circuit board to which the vertical rear bonding portions 221 of the first terminal pins 22 and the vertical rear bonding portions 321 of the second terminal pins 32 are bonded to form a ground loop that provides protection against electromagnetic interference.

Figure 5:
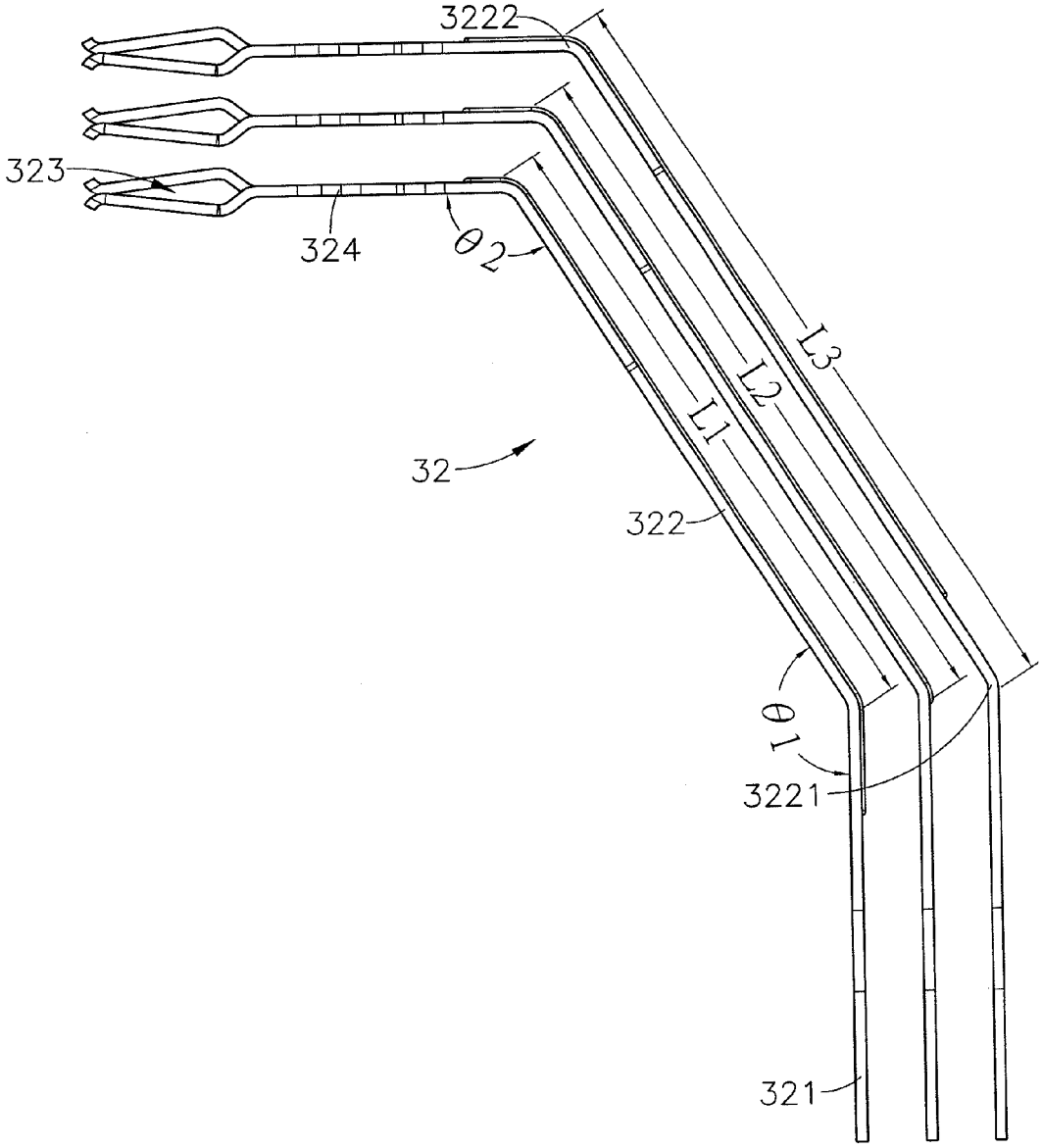
FIG. 5 is a schematic side view of the second terminal pins of the second connector of the digital visual interface dual-stack connector in accordance with the present invention.
Figure 6:
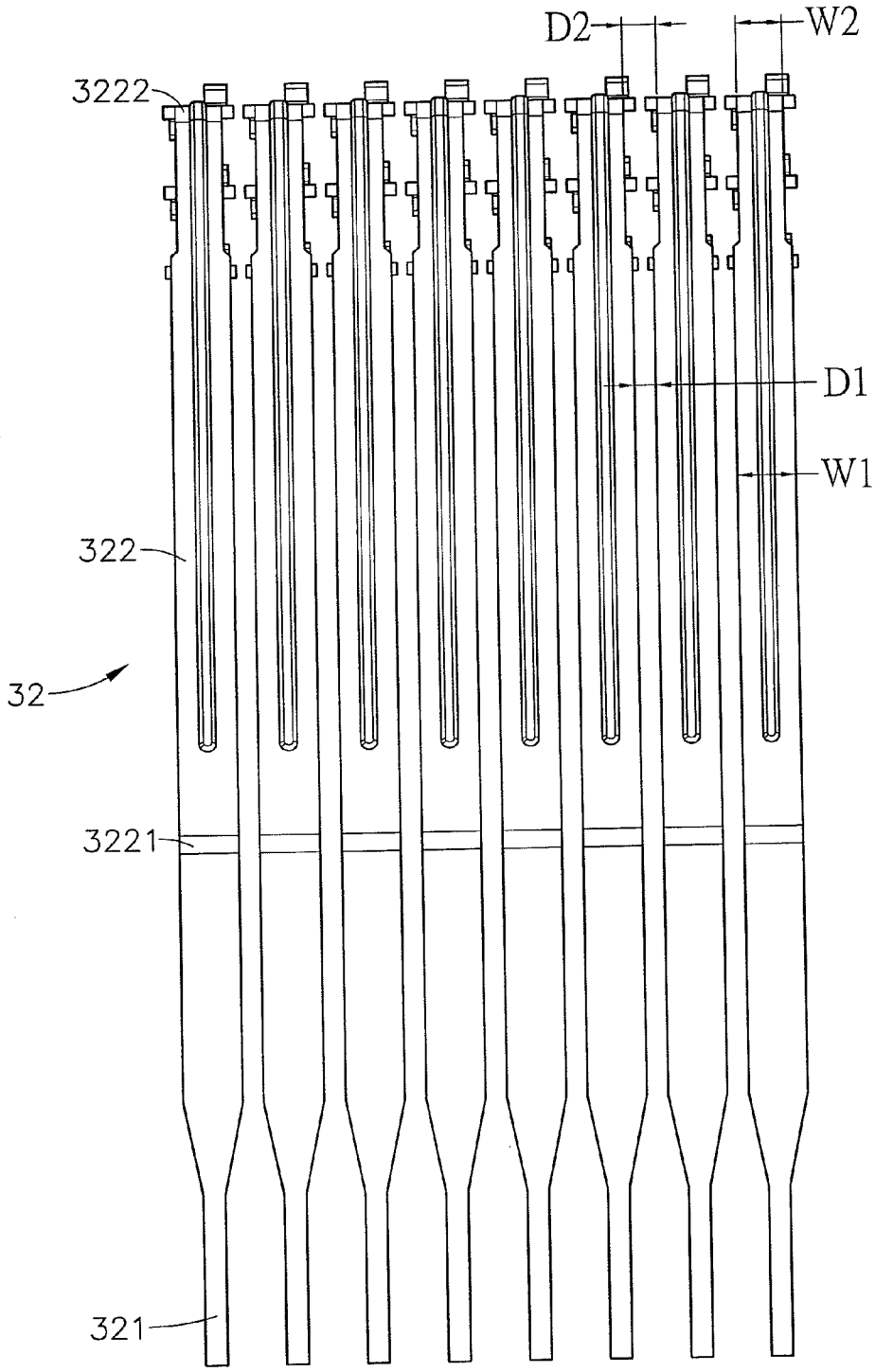
FIG. 6 is a schematic rear side view of the second terminal pins of the second connector of the digital visual interface dual-stack connector in accordance with the present invention.
Figure 7:
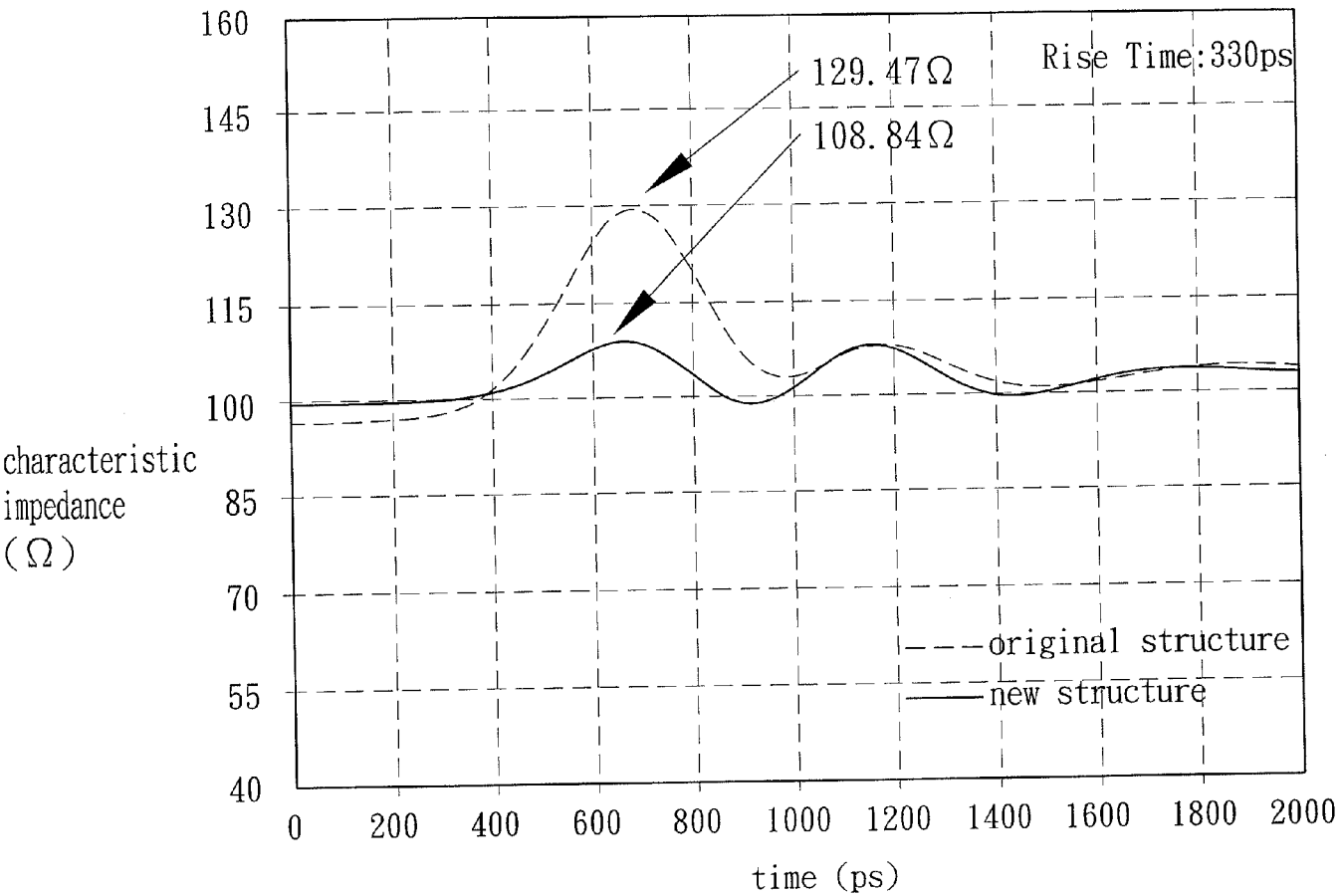
FIG. 7 is a comparison diagram illustrating characteristic impedance difference between a characteristic impedance-time curve obtained from the inner-sided second terminal pins of the present invention and a characteristic impedance-time curve obtained from the prior art design.
Figure 8:
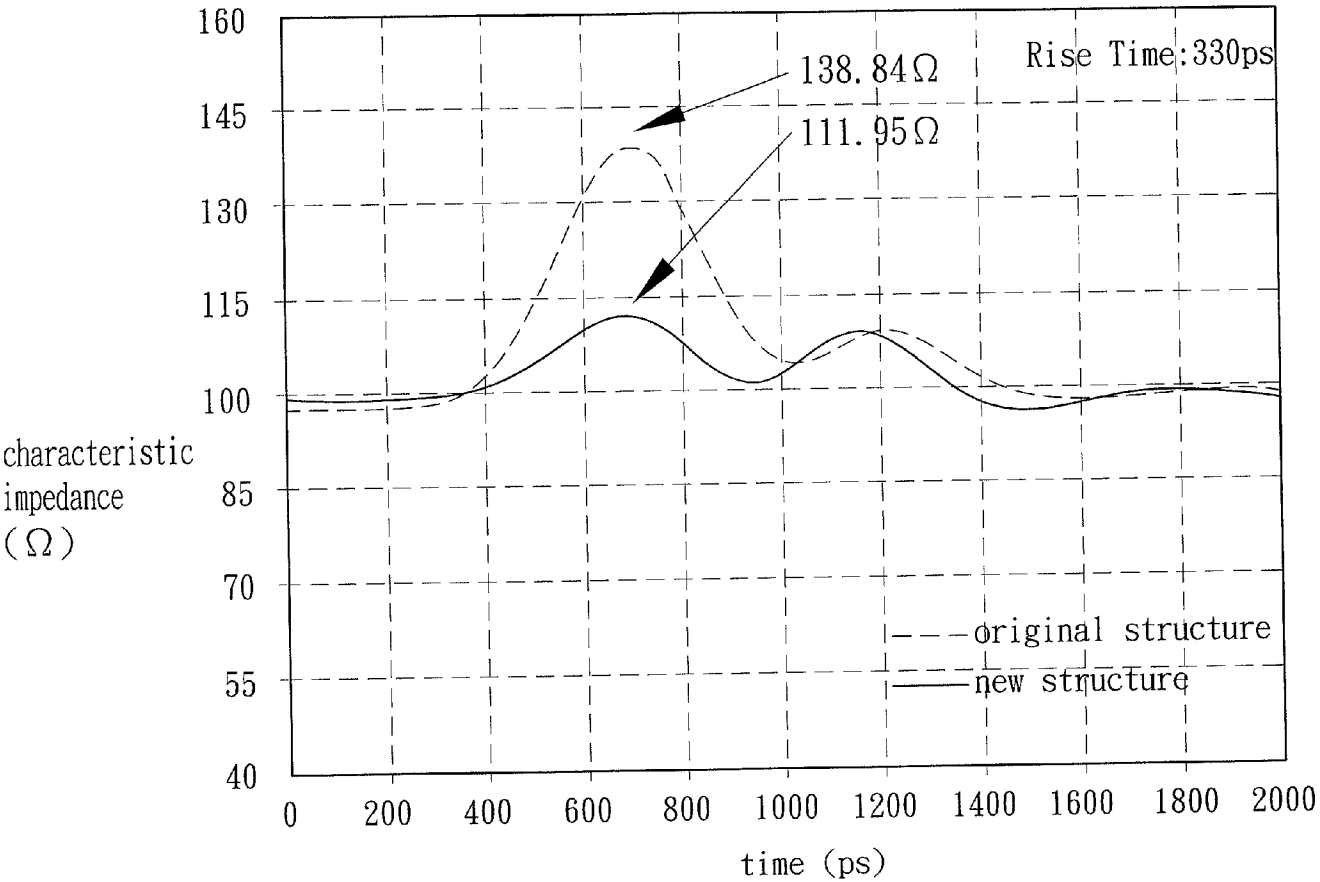
FIG. 8 is a comparison diagram illustrating characteristic impedance difference between a characteristic impedance-time curve obtained from the outer-sided second terminal pins of the present invention and a characteristic impedance-time curve obtained from the prior art design.

Referring to FIGS. 5-8, schematic side view and rear side view of the second terminal pins of the second connector of the digital visual interface dual-stack connector in accordance with the present invention and comparison diagrams illustrating characteristic impedance difference between characteristic impedance-time curves obtained from the inner-sided and outer sided second terminal pins of the present invention and a characteristic impedance-time curves obtained from the prior art design are shown. As illustrated, the horizontal front contact portions 323 of the three sets of second terminal pins 32 of the second connector 3 are arranged at different elevations in the housing 31; the support arm portions 322 of the second terminal pins 32 of the second connector 3 are obliquely connected between the respective vertical rear bonding portions 321 and the respective horizontal front contact portions 323 through the respective first curved portions 3221 and the respective second curved portions 3222.

Further, when a high frequency signal is transmitting through the second terminal pins 32, the characteristic impedance of the inner-sided first set of second terminal pins 32 is about 108.84Ω (the characteristic impedance of the relative terminal pins of the prior art double-layer DVI connector design is about 129.47Ω), and the characteristic impedance of the outer-sided third set of second terminal pins 32 is about 111.95Ω (the characteristic impedance of the relative terminal pins of the prior art double-layer DVI connector design is about 138.84Ω). Thus it is well known that the second terminal pins 32 are properly curved and arranged in three properly spaced sets to increase equivalent capacitance, and the configuration (width, length, etc.) of the second terminal pins 32 are properly controlled to match the characteristic impedance, and therefore the invention effectively reduces high frequency signal reflection and enhances signal integrity, improving signal transmission stability and reliability and maintaining a high level of signal quality.

To achieve the aforesaid effects in actual applications, the second terminal pins 32 are preferably configured subject to the following specifications. The pin height of the second terminal pins is preferably within the range of 19 mm-22 mm, or most preferably 20.4 mm. The bending angle (θ1) of the first curved portion 3221 between the vertical rear bonding portion 321 and the support arm portion 322 is within the range of 120°-125°. The bending angle (θ2) of the second curved portion 3222 between the support arm portion 322 and the horizontal front contact portions 323 (the positioning portions 324) is within the range of 145°-150°. The arm length (L1) of the support arm portions 322 of the inner-sided first set of second terminal pins 32 is within the range of 15.5 mm~18.5 mm. The arm length (L2) of the support arm portions 322 of the middle second set of second terminal pins 32 is within the range of 17.5 mm~20.5 mm. The arm length (L3) of the support arm portions 322 of the outer-sided third set of second terminal pins 32 is within the range of 19.5 mm-22.5 mm. Further, the second terminal pins 32 have a relatively wider first width (W1) and a relatively narrower second width (W2) that is narrower than the first width (W1). The second width (W2) extends a predetermined distance from the top end of the support arm portion 322 in direction toward the horizontal front contact portion 323, and is positioned in the housing 21 subject to the assistance of a positioning tool (not shown). The width of the first width (W1) is preferably within the range of 1.3 mm~1.9 mm, or most preferably 1.4 mm. Further, the pitch (D1) between the first widths (W1) of each two adjacent second terminal pins 32 is preferably within the range of 0.605 mm~0.005 mm, or most preferably 0.505 mm.

The width of the second width (W2) is preferably within the range of 1.0 mm~1.6 mm, or most preferably 1.1 mm. Further, the pitch (D2) between the second widths (W2) of each two adjacent second terminal pins 32 is preferably within the range of 0.905 mm~0.305 mm, or most preferably 0.805 mm.

The specification of the second terminal pins 32 stated above is simply an example but not intended to limit the scope and spirit of the invention. In an alternate form of the present invention, the pin height of the second terminal pins 32 is preferably within the range of 15 mm~18 mm, or most preferably 16.7 mm; the bending angle (θ1) of the first curved portion 3221 between the vertical rear bonding portion 321 and the support arm portion 322 is within the range of 127°~135°; the bending angle (θ2) of the second curved portion 3222 between the support arm portion 322 and the horizontal front contact portions 323 (positioning portions 324) is within the range of 135°~143°; the arm length (L1) of the support arm portions 322 of the inner-sided first set of second terminal pins 32 is within the range of 12.5 mm~15 mm; the arm length (L2) of the support arm portions 322 of the middle second set of second terminal pins 32 is within the range of 14.5 mm~17 mm; the arm length (L3) of the support arm portions 322 of the outer-sided third set of second terminal pins 32 is within the range of 16.5 mm~19 mm. In short, the shape and size of the terminal pins can be changed subject to different requirements and different structural designs to achieve impedance matching and to effectively reduce high frequency signal reflection.

Referring to FIGS. 2, 4, 5 and 6 again, as stated above, the invention provides a digital visual interface dual-stack connector comprising a holder base 1, a first connector 2 mounted in the holder base 1, and a second connector 3 mounted in the holder base 1 above the first connector 2, wherein the second connector 3 comprises a plurality of second terminal pins 2 arranged in three sets; each second terminal pin 2 defines a vertical rear bonding portion 321, a horizontal front contact portion 323, a positioning portion 324 connected between the horizontal front contact portion 323 and the vertical rear bonding portion 321, a support arm portion 322 obliquely connected between the vertical rear bonding portion 321 and the positioning portion 324, a first curved portion 3221 connected between the vertical rear bonding portion 221 and the support arm portion 322, and a second curved portion 3222 connected between the support arm portion 322 and the positioning portion 223. By means of controlling the bending angles of the first curved portion 3221 and the second curved portion 3222 and the pitch between each two adjacent second terminal pins 32, the invention accurately achieves impedance matching to reduce high frequency signal reflection, enhancing signal transmission stability and reliability. Further, the holder base 1 can be made in a L-shaped profile or any other equivalent structural design; the first connector 2 and the second connector 3 can be configured for dual link application, such as DVI-I or DVI-D, or single link application, such as DVI-A, DVI-D or DVI-I.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A digital visual interface dual-stack connector, comprising:

a holder base comprising a vertical frame member, two horizontal frame members formed integral with and bilaterally perpendicularly extended from a bottom side of said vertical frame member;

a first connector mounted in said vertical frame member of said holder base, said first connector comprising a housing defining a slotted mating body portion, and a plurality of first terminal pins mounted in the slotted mating body portion of the housing of said first connector; and a second connector mounted in said vertical frame member of said holder base above the elevation of said first connector, said second connector comprising a housing defining a slotted mating body portion, and a plurality of second terminal pins arranged in three sets including an inner set, an outer set and a middle set between said inner set and said outer set and respectively mounted in the slotted mating body portion of the housing of said second connector at different elevations;

wherein each said second terminal pin comprises a vertical rear bonding portion, a horizontal front contact portion, a support arm portion obliquely connected between said vertical rear bonding portion and said horizontal front contact portion, a first curved portion connected between said vertical rear bonding portion and said support arm portion, and a second curved portion connected between said support arm portion and said horizontal front contact portion, each said second terminal pin having a height preferably within the range of 19 mm~22 mm, said first curved portion having a bending angle within the range of 120°~125°, said second curved portion having a bending angle within the range of 145°~150°, the support arm portions of the inner set of said second terminal pins having a length within the range of 15.5 mm~18.5 mm, the support arm portions of the middle set of said second terminal pins having a length within the range of 17.5 mm~20.5 mm, the support arm portions of the outer set of said second terminal pins having a length within the range of 19.5 mm~22.5 mm, each said second terminal pin having a relatively wider first width and a relatively narrower second width narrower than said first width, said second width extending a predetermined distance from a top end of said support arm portion in direction toward said horizontal front contact portion, said first width being preferably within the range of 1.3 mm~1.9 mm, the pitch between the first widths of each two adjacent said second terminal pins being preferably within the range of 0.605 mm~0.005 mm, said second width being preferably within the range of 1.0 mm~1.6 mm, the pitch between the second widths of each two adjacent said second terminal pins being preferably within the range of 0.905 mm~0.305 mm.

2. The digital visual interface dual-stack connector as claimed in claim 1, wherein said holder base further comprises two connector accommodation spaces defined in top and bottom sides of said vertical frame member for accommodating said first connector and said second connector respectively, a terminal block accommodation space defined between said two horizontal frame members, a terminal block accommodated in said terminal block accommodation space, and a plurality of through holes cut through opposing top and bottom sides of said terminal block for the passing of said first terminal pins of said first connector and said second terminal pins of said second connector.

3. The digital visual interface dual-stack connector as claimed in claim 1, wherein each said first terminal pin comprises a vertical rear bonding portion vertically suspending below the elevation of said horizontal frame members of said holder base, a horizontal front contact portion suspending in the slotted mating body portion of the housing of said first connector, a positioning portion connected between the horizontal front contact portion and vertical rear bonding portion of the respective first terminal pin and positioned in the slotted mating body portion of the housing of said first connector, and a bent connected between the vertical rear bonding portion and the positioning portion of the respective first terminal pin.

4. The digital visual interface dual-stack connector as claimed in claim 1, wherein each said second terminal pin further comprises a positioning portion connected between said horizontal front contact portion and said second curved portion and positioned in the slotted mating body portion of the housing of said second connector.

5. The digital visual interface dual-stack connector as claimed in claim 1, wherein the height of said second terminal pins of said second connector is most preferably 20.4 mm; the width of said first width is most preferably 1.4 mm; the pitch between the first widths of each two adjacent said second terminal pins is most preferably 0.505 mm; the width of said second width is most preferably 1.1 mm; the pitch between the second widths of each two adjacent said second terminal pins is most preferably 0.805 mm.

6. A digital visual interface dual-stack connector, comprising:

a holder base comprising a vertical frame member, two horizontal frame members formed integral with and bilaterally perpendicularly extended from a bottom side of said vertical frame member;

a first connector mounted in said vertical frame member of said holder base, said first connector comprising a housing defining a slotted mating body portion, and a plurality of first terminal pins mounted in the slotted mating body portion of the housing of said first connector; and a second connector mounted in said vertical frame member of said holder base above the elevation of said first connector, said second connector comprising a housing defining a slotted mating body portion, and a plurality of second terminal pins arranged in three sets including an inner set, an outer set and a middle set between said inner set and said outer set and respectively mounted in the slotted mating body portion of the housing of said second connector at different elevations;

wherein each said second terminal pin comprises a vertical rear bonding portion, a horizontal front contact portion, a support arm portion obliquely connected between said vertical rear bonding portion and said horizontal front contact portion, a first curved portion connected between said vertical rear bonding portion and said support arm portion, and a second curved portion connected between said support arm portion and said horizontal front contact portion, each said second terminal pin having a height preferably within the range of 15 mm~18 mm, said first curved portion having a bending angle within the range of 127°~135°, said second curved portion having a bending angle within the range of 135°~143°, the support arm portions of the inner set of said second terminal pins having a length within the range of 12.5 mm~15 mm, the support arm portions of the middle set of said second terminal pins having a length within the range of 14.5 mm~17 mm, the support arm portions of the outer set of said second terminal pins having a length within the range of 16.5 mm~19 mm, each said second terminal pin having a relatively wider first width and a second width narrower than said first width, said second width extending a predetermined distance from a top end of said support arm portion in direction toward said horizontal front contact portion, said first width being preferably within the range of 1.3 mm~1.9 mm, the pitch between the first widths of each two adjacent said second terminal pins being preferably within the range of 0.605 mm~0.005 mm, said second width being preferably within the range of 1.0 mm~1.6 mm, the pitch between the second widths of each two adjacent said second terminal pins being preferably within the range of 0.905 mm~0.305 mm.

7. The digital visual interface dual-stack connector as claimed in claim 6, wherein said holder base further comprises two connector accommodation spaces defined in top and bottom sides of said vertical frame member for accommodating said first connector and said second connector respectively, a terminal block accommodation space defined between said two horizontal frame members, a terminal block accommodated in said terminal block accommodation space, and a plurality of through holes cut through opposing top and bottom sides of said terminal block for the passing of said first terminal pins of said first connector and said second terminal pins of said second connector.

8. The digital visual interface dual-stack connector as claimed in claim 6, wherein each said first terminal pin comprises a vertical rear bonding portion vertically suspending below the elevation of said horizontal frame members of said holder base, a horizontal front contact portion suspending in the slotted mating body portion of the housing of said first connector, a positioning portion connected between the horizontal front contact portion and vertical rear bonding portion of the respective first terminal pin and positioned in the slotted mating body portion of the housing of said first connector, and a bent connected between the vertical rear bonding portion and the positioning portion of the respective first terminal pin.

9. The digital visual interface dual-stack connector as claimed in claim 6, wherein each said second terminal pin further comprises a positioning portion connected between said horizontal front contact portion and said second curved portion and positioned in the slotted mating body portion of the housing of said second connector.

10. The digital visual interface dual-stack connector as claimed in claim 6, wherein the height of said second terminal pins of said second connector is most preferably 16.7 mm; the width of said first width is most preferably 1.4 mm; the pitch between the first widths of each two adjacent said second terminal pins is most preferably 0.505 mm; the width of said second width is most preferably 1.1 mm; the pitch between the second widths of each two adjacent said second terminal pins is most preferably 0.805 mm.

* * * * *